US011268248B2

(12) United States Patent
Fowler et al.

(10) Patent No.: US 11,268,248 B2
(45) Date of Patent: Mar. 8, 2022

(54) ARTIFICIAL TURF AND ASSOCIATED DEVICES AND METHODS FOR MAKING SAME

(71) Applicant: COLUMBIA INSURANCE COMPANY, Omaha, NE (US)

(72) Inventors: Gregory D. Fowler, Ringgold, GA (US); Phil Stricklen, Dalton, GA (US); Lisa Porter, Ringgold, GA (US)

(73) Assignee: COLUMBIA INSURANCE COMPANY, Omaha, NE (US)

( * ) Notice: Subject to any disclaimer, the term of this patent is extended or adjusted under 35 U.S.C. 154(b) by 0 days.

(21) Appl. No.: 16/207,776

(22) Filed: Dec. 3, 2018

(65) Prior Publication Data

US 2019/0100885 A1 Apr. 4, 2019

Related U.S. Application Data

(62) Division of application No. 14/712,446, filed on May 14, 2015, now abandoned.

(60) Provisional application No. 61/996,815, filed on May 14, 2014.

(51) Int. Cl.

| | |
|---|---|
| ***E01C 13/08*** | (2006.01) |
| ***D02G 3/44*** | (2006.01) |
| ***D05C 15/10*** | (2006.01) |
| ***D05C 15/36*** | (2006.01) |
| ***D05C 15/18*** | (2006.01) |

(52) U.S. Cl.

CPC ..... *E01C 13/08* (2013.01); *D02G 3/445* (2013.01); *D05C 15/10* (2013.01); *D05C 15/18* (2013.01); *D05C 15/36* (2013.01); *D10B 2505/202* (2013.01)

(58) Field of Classification Search

None

See application file for complete search history.

(56) References Cited

U.S. PATENT DOCUMENTS

| | | | |
|---|---|---|---|
| 1,152,379 | A | 8/1915 | Hathaway et al. |
| 1,153,865 | A | 9/1915 | Hathaway et al. |
| 1,341,417 | A | 5/1920 | Davis |
| 3,020,863 | A | 2/1962 | Smith |
| 3,356,048 | A | 12/1967 | Haas |

(Continued)

FOREIGN PATENT DOCUMENTS

| | | | |
|---|---|---|---|
| AU | 2010212281 | * | 3/2011 |
| AU | 2010212281 | A1 | 3/2011 |

(Continued)

OTHER PUBLICATIONS

Machine translation of JP2002115139, Kawabata et al. (Year: 2002).*

(Continued)

*Primary Examiner* — Shawn McKinnon

(74) *Attorney, Agent, or Firm* — Ballard Spahr LLP

(57) ABSTRACT

Implementations herein describe an artificial turf having a backing layer and a plurality of rows of individual tufts tufted into the backing layer. Each tuft comprises at least three yarns per tuft and each one of the at least three yarns varies in at least one of material, color, texture, denier and cross-section. Each row of individual tufts is substantially similar to each adjacent tufted row and adjacent tufts on a given row are spaced apart at a predetermined gauge.

16 Claims, 4 Drawing Sheets

(56) References Cited

U.S. PATENT DOCUMENTS

| | | | | |
|---|---|---|---|---|
| 3,595,185 | A | 7/1971 | Shorrock et al. | |
| 3,641,956 | A | 2/1972 | Ownbey | |
| 3,847,098 | A | 11/1974 | Hammel, Jr. | |
| 3,940,522 | A | 2/1976 | Wessells | |
| 4,531,465 | A | 7/1985 | Hampton | |
| 4,549,496 | A * | 10/1985 | Kile | D05C 15/34 112/80.08 |
| 5,080,028 | A | 1/1992 | Ingram | |
| 5,165,352 | A | 11/1992 | Ingram | |
| 5,462,778 | A | 10/1995 | Ishikawa | |
| 5,588,383 | A | 12/1996 | Davis et al. | |
| 5,738,030 | A | 4/1998 | Ok | |
| 5,983,815 | A | 11/1999 | Card | |
| 6,009,818 | A | 1/2000 | Card et al. | |
| 6,273,011 | B1 | 8/2001 | Amos | |
| 6,293,211 | B1 | 9/2001 | Samilo | |
| 6,344,254 | B1 | 2/2002 | Smith et al. | |
| 6,401,639 | B1 | 6/2002 | Samilo | |
| 6,491,991 | B2 | 12/2002 | Seaton | |
| 6,527,889 | B1 | 3/2003 | Paschal et al. | |
| 6,834,601 | B2 | 12/2004 | Card et al. | |
| 6,895,877 | B1 | 5/2005 | Weiner | |
| 6,945,183 | B2 | 9/2005 | Card et al. | |
| 6,945,184 | B2 | 9/2005 | Frost et al. | |
| 7,096,806 | B2 | 8/2006 | Card et al. | |
| 7,357,966 | B2 | 4/2008 | Dippie et al. | |
| 7,399,514 | B2 | 7/2008 | De Clerck | |
| 7,506,831 | B1 | 3/2009 | Weiner | |
| 7,814,850 | B2 | 10/2010 | Bearden | |
| 7,874,320 | B2 | 1/2011 | Knapp et al. | |
| 7,905,187 | B2 | 3/2011 | Card et al. | |
| 7,955,194 | B2 | 6/2011 | Avery | |
| 8,201,509 | B2 | 6/2012 | Christman, Jr. | |
| 8,413,597 | B1 | 4/2013 | Samilo | |
| 8,443,743 | B2 * | 5/2013 | Christman, Jr. | D05C 15/34 112/470.01 |
| 10,125,441 | B1 | 11/2018 | Weiner | |
| 2004/0019425 | A1 | 1/2004 | Zorka et al. | |
| 2004/0195425 | A1 | 10/2004 | Jensen | |
| 2006/0099380 | A1 | 5/2006 | Vollmert et al. | |
| 2006/0107880 | A1 * | 5/2006 | Peeples | D05C 15/16 112/80.41 |
| 2008/0125237 | A1 | 5/2008 | Avery | |
| 2010/0101687 | A1 | 4/2010 | Sugawara | |
| 2012/0189785 | A1 * | 7/2012 | Rossing | D01D 5/253 428/17 |
| 2013/0047904 | A1 | 2/2013 | Vaughn | |
| 2013/0098531 | A1 * | 4/2013 | Morton-Finger | E01C 13/08 156/72 |
| 2014/0093663 | A1 | 4/2014 | Ishimaru | |

FOREIGN PATENT DOCUMENTS

| | | | |
|---|---|---|---|
| CN | 87100109 | A | 7/1987 |
| CN | 1014846 | B | 11/1991 |
| CN | 1401036 | A | 3/2003 |
| CN | 1723320 | A | 1/2006 |
| CN | 1735719 | A | 2/2006 |
| CN | 103635632 | A | 3/2014 |
| EP | 0858769 | A2 | 8/1998 |
| EP | 2004885 | A2 | 12/2008 |
| GB | 382943 | A | 10/1932 |
| GB | 1112595 | A | 5/1968 |
| GB | 1363974 | A | 8/1974 |
| GB | 1438464 | A | 6/1976 |
| GB | 2393454 | A | 3/2004 |
| JP | 2002115139 | * | 4/2002 |
| JP | 2002115139 | A | 4/2002 |
| WO | WO-2001/061110 | A1 | 8/2001 |
| WO | WO-2010/128196 | A1 | 11/2010 |
| WO | WO-2015/175786 | A1 | 11/2015 |

OTHER PUBLICATIONS

Bulked Continuous Filament—[http://www.probrite.net/define.asp?def=Bulked%20Continuous%20Filament%20(BCF)]. (Year: 2021).*

Sportexe (http://www.niaaa.org/assets/NIAAA-Turf-Workbook.pdf, page visited on Sep. 14, 2017).

International Search Report and Written Opinion dated Jul. 31, 2015 by the International Searching Authority for International Patent Application No. PCT/US2015/030790, which was filed on May 14, 2015 and published as WO 2015/175786, and filed on Nov. 19, 2015 (Inventor—Fowler et al.; Applicant—Shaw Industries Group, Inc.;) (11 pages).

International Preliminary Report on Patentability was dated Nov. 15, 2016 by the International Searching Authority for International Application No. PCT/US2015/030790, which was filed on May 14, 2015 and published as WO 2015/175786, and filed on Nov. 19, 2015 (Inventor—Fowler et al.; Applicant—Shaw Industries Group, Inc.;) (7 pages).

Supplementary European Search Report dated Dec. 22, 2017 by the European Patent Office for Patent Application No. 15792758.3, which was filed on May 14, 2015 and published as EP3143207 on Mar. 22, 2017 (Inventor—Fowler et al.; Applicant—Shaw Industries Group, Inc.;) (6 pages).

First Office Action dated Apr. 25, 2018 by the SIPO for CN Patent Application No. 2015800250279, which was filed on May 14, 2015 and published as CN 106460348 on Feb. 22, 2017 (Applicant—Shaw Industries Group, Inc.)(Original—8 pages//Translation—7 pages).

Requirement for Restriction/Election was dated Mar. 23, 2017 by the USPTO for U.S. Appl. No. 14/712,446, which was filed May 14, 2015 and published as US 2015-0354147 A1 on Dec. 10, 2015 (Inventor—Fowler et al.) (6 pages).

Response to Requirement for Restriction/Election was dated May 9, 2017 to the USPTO for U.S. Appl. No. 14/712,446, which was filed May 14, 2015 and published as US 2015-0354147 A1 on Dec. 10, 2015 (Inventor—Fowler et al.) (6 pages).

Non Final Rejection was dated May 19, 2017 by the USPTO for U.S. Appl. No. 14/712,446, which was filed May 14, 2015 and published as US 2015-0354147 A1 on Dec. 10, 2015 (Inventor—Fowler et al.) (10 pages).

Response Non Final Rejection was dated Aug. 21, 2017 to the USPTO for U.S. Appl. No. 14/712,446, which was filed May 14, 2015 and published as US 2015-0354147 A1 on Dec. 10, 2015 (Inventor—Fowler et al.) (11 pages).

Final Rejection was dated Sep. 20, 2017 by the USPTO for U.S. Appl. No. 14/712,446, which was filed May 14, 2015 and published as US 2015-0354147 A1 on Dec. 10, 2015 (Inventor—Fowler et al.) (11 pages).

Response to Final Rejection was dated Jan. 18, 2018 to the USPTO for U.S. Appl. No. 14/712,446, which was filed May 14, 2015 and published as US 2015-0354147 A1 on Dec. 10, 2015 (Inventor—Fowler et al.) (8 pages).

Non Final Rejection was dated Jan. 18, 2018 by the USPTO for U.S. Appl. No. 14/712,446, which was filed May 14, 2015 and published as US 2015-0354147 A1 on Dec. 10, 2015 (Inventor—Fowler et al.) (8 pages).

Response to Non Final Rejection was dated May 18, 2018 to the USPTO for U.S. Appl. No. 14/712,446, which was filed May 14, 2015 and published as US 2015-0354147 A1 on Dec. 10, 2015 (Inventor—Fowler et al.) (8 pages).

Final Rejection was dated Jul. 3, 2018 by the USPTO for U.S. Appl. No. 14/712,446, which was filed May 14, 2015 and published as US 2015-0354147 A1 on Dec. 10, 2015 (Inventor—Fowler et al.) (10 pages).

Notice of Abandonment was dated Jan. 11, 2019 by the USPTO for U.S. Appl. No. 14/712,446, which was filed May 14, 2015 and published as US 2015-0354147 A1 on Dec. 10, 2015 (Inventor—Fowler et al.) (2 pages).

Third Office Action was dated Sep. 24, 2019 by the SIPO for CN Application No. 2015800250279, filed on May 14, 2015 and published as CN 106460348 on Feb. 22, 2017 (Applicant—Shaw Industries Group,Inc.) (Translation—7 Pages).

* cited by examiner

ARTIFICIAL TURF AND ASSOCIATED DEVICES AND METHODS FOR MAKING SAME

RELATED APPLICATIONS

This application is a divisional of co-pending U.S. patent application Ser. No. 14/712,446, filed on May 14, 2015, which claims priority to U.S. Provisional Patent Application No. 61/996,815, filed on May 14, 2014. Each of these applications is incorporated herein by reference in its entirety.

BACKGROUND

Field of the Invention

This invention relates generally to artificial turf and, more particularly, to artificial turf having tufts comprised of at least three distinct yarns as well as devices and methods for making the same.

Description of the Related Art

Artificial turf surfaces are widely used as playing field surfaces for sports such as tennis, football, soccer, baseball, and golf. Conventional artificial turf surfaces are most frequently made of artificial turf or synthetic grass-like carpeting which is intended to simulate natural grass. However, these conventional artificial turf surfaces suffer from a number of limitations. In one aspect, some artificial turf can exhibit linear striping due to variations in adjacent tuft rows and, in other aspects, can be challenging for an installer to cut and match sections to ensure a uniform appearance. In other aspects, many turf companies use twisted yarns which results in additional manufacturing expense.

Accordingly, a need exists for artificial turf surfaces that have a more grass-like aesthetic and that are less expensive and easier to install.

SUMMARY

It is to be understood that this summary is not an extensive overview of the disclosure. This summary is exemplary and not restrictive, and it is intended to neither identify key or critical elements of the disclosure nor delineate the scope thereof. The sole purpose of this summary is to explain and exemplify certain concepts of the disclosure as an introduction to the following complete and extensive detailed description.

In one aspect, the present disclosure describes an artificial turf having a backing layer and a plurality of rows of individual tufts tufted into the backing layer. In further aspects, each tuft comprises at least three yarns per tuft, wherein each one of the at least three yarns varies from the others in at least one of material, color, texture, tuft denier, denier per filament, cross-section and the like. In other aspects, one of the at least three yarns comprises a wrap yarn. In yet other aspects, a given tufted row of the plurality of tufted rows is substantially similar to each adjacent tufted row.

In another aspect, the present disclosure provides for a tufting assembly having a plurality of needles, a creel assembly, and a plurality of tensioners. In one aspect, each needle of the plurality of needles is adapted to receive at least a first yarn, a second yarn, and a third yarn. In a further aspect, each of the first yarn, the second yarn, and the third yarn can be selected to be distinct from each other. In one aspect, the creel assembly has at least three post positions associated with each needle and each post position is operable to receive a yarn bundle having one of at least the first yarn, the second yarn and the third yarn. In another aspect, each one of the plurality of tensioners is associated with each of the first yarn, the second yarn and the third yarn. In a further aspect, a tension associated with each tensioner can be selectively modified such that substantially equal tension between the first, second and third yarns can be delivered to each needle. In a further aspect, each of the plurality of needles is adapted to tuft at least the first yarn, the second yarn and the third yarn simultaneously through at least a primary backing layer.

Additional features and advantages of exemplary implementations of the invention will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

The accompanying drawings, which are incorporated in and constitute a part of this specification, illustrate aspects and together with the description, serve to explain the principles of the methods and systems.

DETAILED DESCRIPTION

Figure 1:
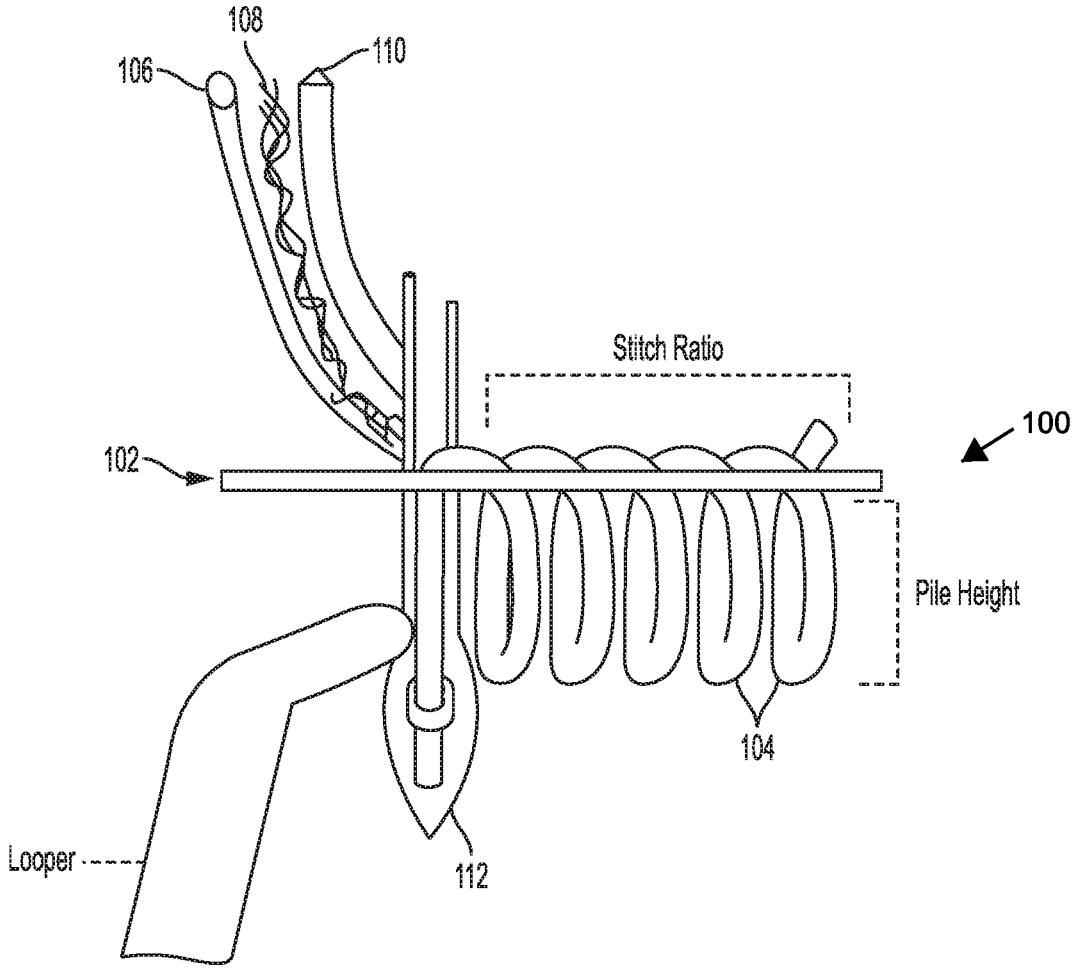
FIG. 1 depicts one aspect of a tufting machine where three yarns are fed through one needle to form a loop pile according to the present disclosure.

The present invention can be understood more readily by reference to the following detailed description, examples, drawing, and claims, and their previous and following description. However, before the present devices, systems, and/or methods are disclosed and described, it is to be understood that this invention is not limited to the specific devices, systems, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known aspect. To this end, those skilled in the relevant art will recognize and appreciate that many changes can be made to the various aspects of the invention described herein, while still obtaining the beneficial results described herein. It will also be apparent that some of the desired benefits described herein can be obtained by selecting some of the features described herein without utilizing other features. Accordingly, those who work in the art will recognize that many modifications and adaptations to the present invention are possible and can even be desirable in certain circumstances and are a part described herein. Thus, the following description is provided as illustrative of the principles described herein and not in limitation thereof.

Reference will be made to the drawings to describe various aspects of one or more implementations of the invention. It is to be understood that the drawings are diagrammatic and schematic representations of one or more implementations, and are not limiting of the present disclosure. Moreover, while various drawings are provided at a scale that is considered functional for one or more implementations, the drawings are not necessarily drawn to scale for all contemplated implementations. The drawings thus represent an exemplary scale, but no inference should be drawn from the drawings as to any required scale.

In the following description, numerous specific details are set forth in order to provide a thorough understanding described herein. It will be obvious, however, to one skilled in the art that the present disclosure may be practiced without these specific details. In other instances, well-known aspects of carpet manufacture and artificial turf have not been described in particular detail in order to avoid unnecessarily obscuring aspects of the disclosed implementations.

As used in the specification and the appended claims, the singular forms "a," "an" and "the" include plural referents unless the context clearly dictates otherwise. Ranges may be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

"Optional" or "optionally" means that the subsequently described event or circumstance may or may not occur, and that the description includes instances where said event or circumstance occurs and instances where it does not.

Throughout the description and claims of this specification, the word "comprise" and variations of the word, such as "comprising" and "comprises," means "including but not limited to," and is not intended to exclude, for example, other additives, components, integers or steps. "Exemplary" means "an example of" and is not intended to convey an indication of a preferred or ideal aspect. "Such as" is not used in a restrictive sense, but for explanatory purposes.

Disclosed are components that can be used to perform the disclosed methods and systems. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all methods and systems. This applies to all aspects of this application including, but not limited to, steps in disclosed methods. Thus, if there are a variety of additional steps that can be perdefined it is understood that each of these additional steps can be perdefined with any specific aspect or combination of aspects of the disclosed methods.

Implementations described herein and depicted in FIGS. 1-4 provide for an artificial turf 100 having a backing layer 102 and a plurality of rows of individual tufts 104 tufted into the backing layer. In further aspects, each tuft 104 comprises at least three yarns 106, 108, 110 per tuft, wherein each one of the at least three yarns varies from the others in at least one of material, color, texture, tuft denier, denier per filament, cross-section and the like. Optionally, each one of the at least three yarns can vary from the others in at least two of material, color, texture, tuft denier, denier per filament, cross-section and the like. In a further aspect, each one of the at least three yarns varies from the others in three or more of material, color, texture, tuft denier, denier per filament, cross-section and the like.

It is contemplated to use at least three distinct yarns tufted through an eye 113 of a single needle 112 to provide a number of advantages over conventional artificial turf. In one aspect, use of three distinct yarns tufted through an eye of one needle can provide the artificial turf with a uniform surface appearance that is, in other aspects, random in nature based on the differences of the at least three yarns. In one aspect, using at least three distinct yarns per tuft can yield a more natural look and can help disguise seams. Additionally, unfilled or uninstalled artificial turf of the present disclosure can provide a better point of purchase presentation due to the tufts comprising at least three fibers. In light of the present disclosure, one skilled in the art will appreciate that having fewer than three yarns per stitched tuft can result in undesirable liner striping of the finished product.

Conventionally, turf face yarns are selected based on a combination of the end use and aesthetic appeal. In sports, the usage or traffic load is studied before selecting the best yarn for tufting. Fibrillated tape yarns are typically used for extra heavy traffic usage but do not look like natural grass blades when compared to other monofilament yarns available. The varieties of yarns available to yarn spinners is broad and enables manufacture of a turf product that looks and feels like natural grass based on the proper selection of resin and cross-section. In other aspects, delusterants can be utilized to impart the turf with a more natural look. In other aspects, highly textured yarns may be used to emulate dead grass or emerging grass blades. This textured yarn can also provide additional benefits such as providing a structured area in a selected zone of the turf vertical or horizontal profile. Accordingly, infill splash can be diminished and the overall stiffness of the turf can be increased. Varying bulk levels can be selected to impart a desired appearance to the turf structure as well. Accordingly, use of at least three yarns per tufted needle enables a high degree of customization of features to achieve an artificial turf having improved performance and aesthetics over conventional artificial turf.

In another aspect, use of at least three yarns per tuft, where each tuft comprises a tuft denier that is the sum of the respective denier of each of the at least three yarns, can provide for a direct reduction in tufting costs. The larger yarn bundles used herein, given the same yarn weight, gauge and pile height, can allow for lower stitch rates resulting in greater machine production per hour. As one skilled in the art will appreciate, the stitch rate is directly correlated to the yarn being stitched such that a higher denier correlates to a lower stitch rate when pile height, yarn weight and gauge are held constant and it is contemplated that use of the larger yarn bundles described herein can result in a stitch rate reduction and, more preferably, a stitch rate reduction of from about 30 to about 40%. In one aspect, the tuft denier of tuft can range from about 3,000 to about 60,000 and, more preferentially from about 10,800 to about 16,600 and the denier of each of the at least three yarns can range from about 70 to about 20,000 and, more preferentially from about 100 to about 7500. For example, a 10,800 denier yarns can require 19.5 stiches per each 6" at 2.0" pile height using ½" gauge to yield 40 oz. yarn weight per square yard and a denier of 16,600 allows for a reduction in the stitch rate of 35% or of about 6.8 stiches per 6".

Many conventional artificial turf products employ a twisting process to combine two yarns together to feed into a single needle or a resulting tuft. Utilization of at least three yarns per tuft, as provided herein, can allow the twisting process to be bypassed. The savings due to omitting the twisting step can be about $0.25 per pound or an average of $0.75 per square yard of turf. On a typical American football field of about 9,000 sq. yards, this scales to a savings of $6,750.

In other aspects, one of the at least three yarns can comprise a wrap yarn or a bulk continuous fiber (BCF) yarn. Use of a BCF fiber, as contemplated herein can avoid the expense of twisting by utilizing a wrap yarn to hold multiple filaments together. (However, one skilled in the art will appreciate that use of twisting is also contemplated within the scope of the present disclosure.) In one aspect, the wrap yarn can comprise one of a low-bulk, low temperature-shrinkage fiber; a medium-bulk, low temperature-shrinkage fiber; and a high-bulk, low temperature shrinkage fiber that is configured to shrink down to a selected pile level during the tufting and coating process or subsequent heat treatment. As one skilled in the art will appreciate, having additional BCF yarn incorporated into each tuft can enable a greater degree of bundle wrap by the coating. In one example, tuft bind increases of from about 10% to about 20% have been observed due to use of BCF yarn as described above. In one exemplary aspect, three yarns having identical cross-sections can be selected to differ in their shrinkage rates such that the resultant finished turf comprises tufts having small, medium and large blades. One skilled in the art will appreciate the range of possible combinations of different yarn characteristics that can be achieved herein.

In other aspects, at least one texturized yarn thread can be utilized in the tuft. It is contemplated that texturized yarn can trap infill and can desirably reduce infill migration during athletic or other activity. Additionally, it is further contemplated that evenly distributing the texturized yarn can maximize the benefit of reduced migration.

In other aspects, at least one slit tape yarn can be employed in the tuft and, in a further aspect, the slit tape yarn can be configured to fold over on the surface. As used herein, the term slit tape yarn comprises, for example and without limitation, conventional slit tape yarn, monofilament slit tape yarn and the like. It is contemplated that the slit tape yarn can reduce the tendency of rubber infill to splash when the surface of the artificial turf is impacted by, for example, a ball, a player or the like. As with texturized yarn, it is contemplated that even distribution of the slit tape yarn will maximize the benefit of splash reduction.

In other aspects, at least one monofilament yarn can be employed in the tuft. It is further contemplated that adjusting or controlling the rigidity of the fibers can selectively control the roll of a ball on the surface of the resultant artificial turf. As the stiffness or rigidity of the monofilament yarn increases, the fibers exhibit increased resistance to the ball and vice-versa. Accordingly, is contemplated to select a monofilament yarn appropriate to control the roll of a ball according to end use requirements. In a further aspect, it is contemplated that a more even distribution of the monofilament yarns can ensure a ball will roll evenly in all directions and that even distribution of monofilament yarns of a selected rigidity or stiffness can provide uniform ball roll control.

In other aspects, the artificial turf can comprise an infill material disposed on a top surface of the backing layer an in between the tufts. The infill material can comprise any known infill material such as, for example and without limitation, rubber particles, sand, natural materials and the like.

In other aspects, each yarn of the at least three yarns can comprise any cross-section known in the art and, in certain aspects, the at least three yarns can comprise a cross-section of at least one of a diamond, a rectangle, a serrated diamond, an oval or otherwise round cross section, a spine, a celery, a serrated celery, a tri-lobal, a winged tri-lobal and the like. In another aspect at least one yarn of the at least three yarns can comprise cross-sections disclosed in U.S. patent application Ser. No. 13/951,133 entitled "Yarn Filament for Artificial Turf and Method for Making the Same and filed on Jul. 25, 2013, and U.S. patent application Ser. No. 13/922,967 entitled "Yarn Filament and Method for Making the Same and filed on Jun. 20, 2013, both of which are hereby incorporated by reference in their respective entireties.

In other aspects, each yarn of the at least three yarns can comprise a material selected from the group comprising LDPE, MDPE, Nylon, PP, PET, PLA and co-extruded bio-materials thereof.

In other aspects, a given tufted row of the plurality of tufted rows is substantially similar to each adjacent tufted row and, in a further aspect, adjacent tufts on a given row are spaced apart at a predetermined gauge. An artificial turf having a plurality of tufted rows substantially similar to each adjacent row can allow a turf installer to cut and install the turf without regard to matching tufted rows. One skilled in the art will appreciate that eliminating the need to match tufted rows can decrease the cost of turf installation by up to about 40%.

In light of the present disclosure, one skilled in the art will appreciate that, in addition to tufting methods disclosed above, it is contemplated that weaving, knitting, and fusion bonding are methods that can be used to produce the artificial turf of the present disclosure. Additionally, in light of the present disclosure, one skilled in the art will appreciate that various methods for delivering three or more yarns into a turf product could be used such as single needle control with three feed yarns simultaneously feeding or tufting with beams.

Additional implementation described herein provide for a tufting assembly having a plurality of needles, a creel assembly and a plurality of tensioners. In one aspect, each needle of the plurality of needles is adapted to receive at least a first yarn 106, a second yarn 108, and a third yarn 110. In a further aspect, each of the first yarn, the second yarn, and the third yarn are selected to be distinct from each other. In one aspect, the creel assembly has at least three post positions associated with each needle and each post position is operable to receive a yarn bundle having one of at least the first yarn, the second yarn and the third yarn. In another aspect, each one of the plurality of tensioners is associated with each of the first yarn, the second yarn and the third yarn. In a further aspect, a tension associated with each tensioner can be selectively modified such that substantially equal tension between the first, second and third yarns can be delivered to each needle. Optionally, the tension associated with each tensioner can be selectively modified such that at least two of the tensions in the respective first, second and third yarns delivered to each needle can be substantially equal.

Figure 2:
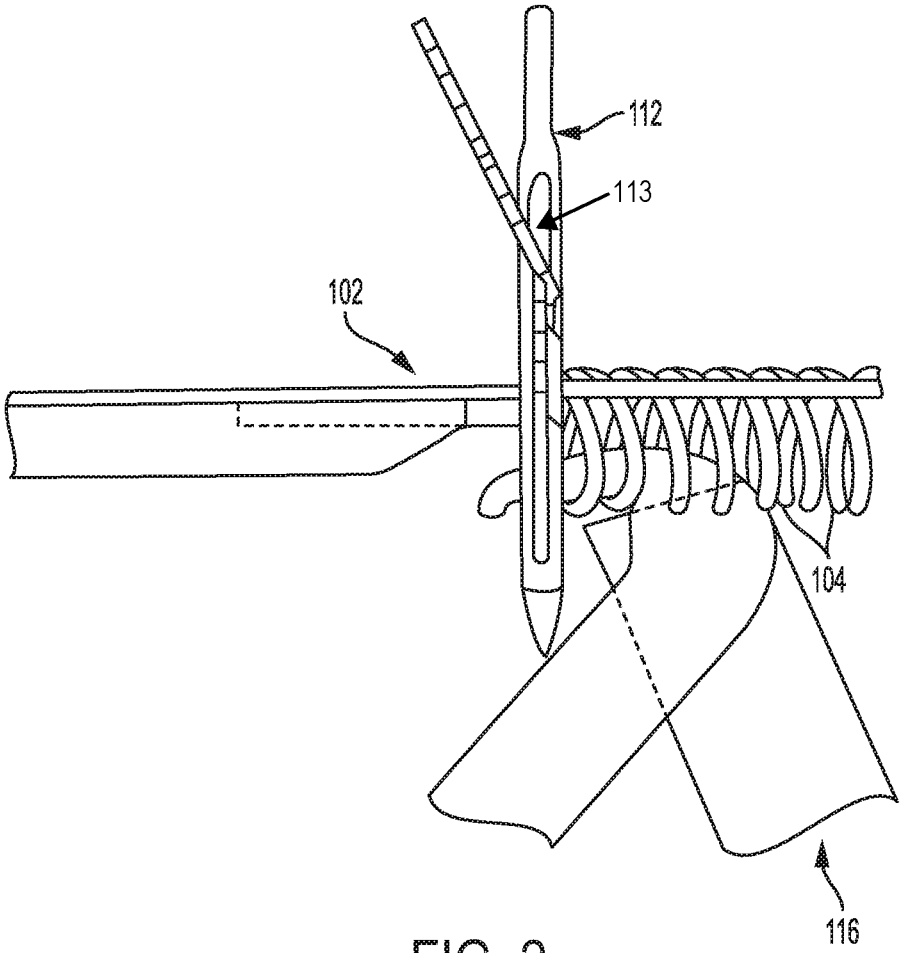
FIG. 2 depicts one aspect of a tufting machine where three yarns are fed through one needle to form a cut pile according to the present disclosure.
Figure 3:
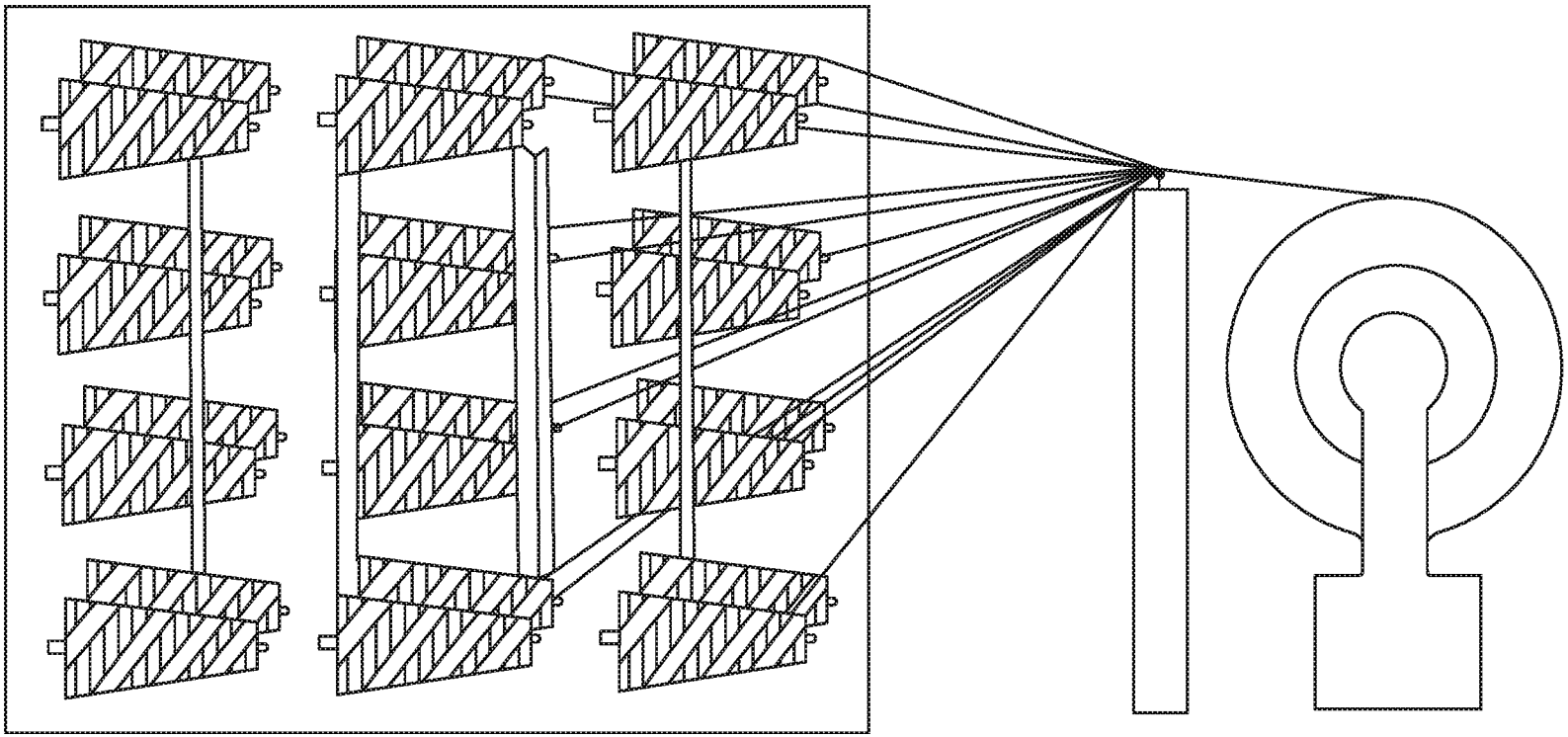
FIG. 3 depicts an alternative method for manufacturing the artificial turf described herein employing tufting from beams.
Figure 4:
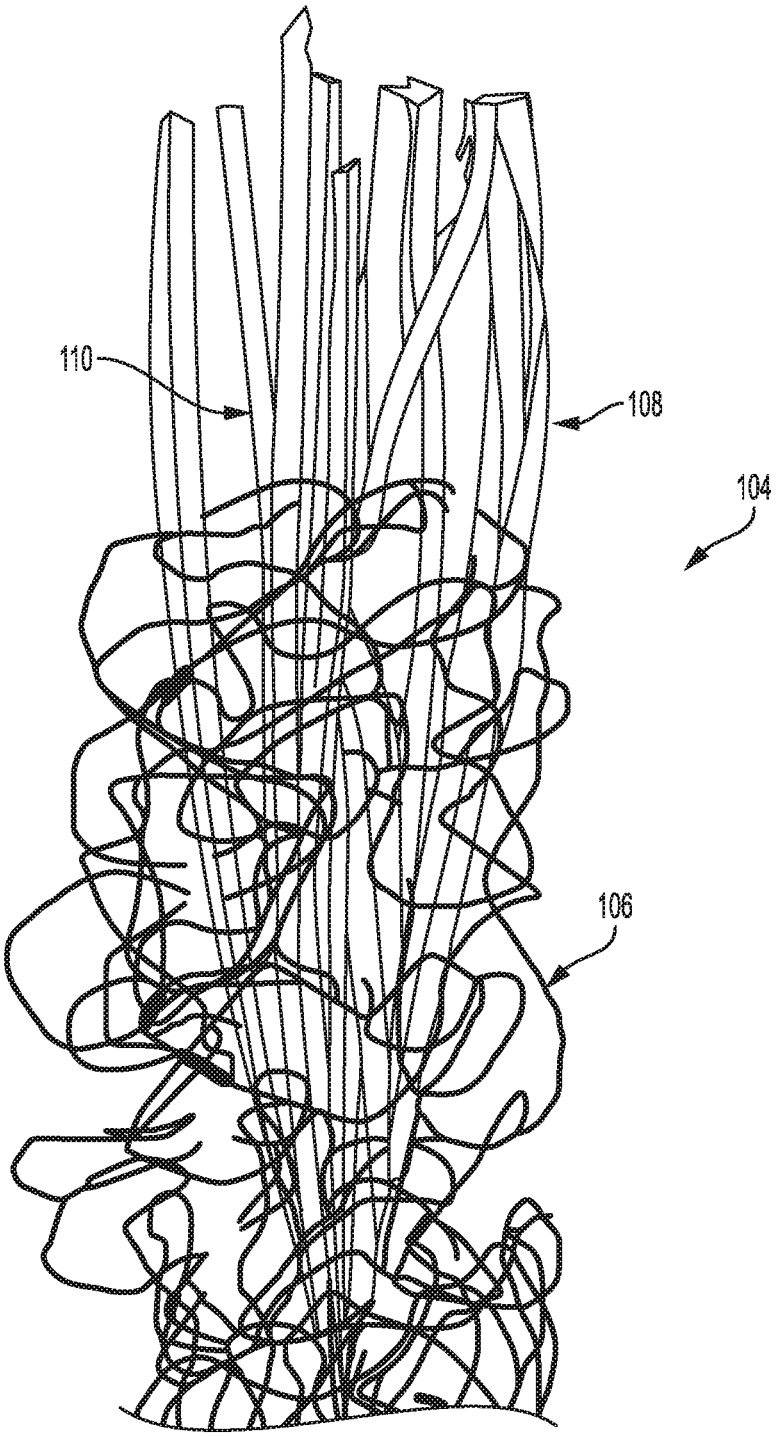
FIG. 4 depicts one aspect of a tuft of the present disclosure.

In a further aspect, each of the plurality of needles 112 is adapted to tuft at least the first yarn, the second yarn and the third yarn simultaneously through at least a primary backing layer 102. In an even further aspect, a plurality of feed rollers can be provided, where each yarn has a corresponding feed roller in order to accommodate different yarn resins and corresponding coefficient of friction. In other aspects and as shown in FIG. 2, at least the first yarn, the second yarn and the third yarn comprise a loop 114 and, in a further aspect, the at least one loop can be at least partially cut by a hook and knife assembly 116. In an alternative aspect illustrated in FIG. 3, tufting from beams can be employed as an alternative method for producing the artificial turf described herein.

Accordingly, FIGS. 1-4, and the corresponding text, provide a number of different artificial turf configurations, as well as the devices, methods to form the different artificial turf configurations. In addition to the foregoing, implementations described herein can also be described in terms acts and steps in a method for accomplishing a particular result. For example, a method comprising forming an artificial turf by providing a first, a second and a third yarn, threading the yarns through an eye of a single needle, and applying the needle to a backing to form a tuft is described concurrently above with reference to the components and diagrams of FIGS. 1-4.

The present invention can thus be embodied in other specific forms without departing from its spirit or essential characteristics. The described aspects are to be considered in all respects only as illustrative and not restrictive. The scope of the invention is, therefore, indicated by the appended claims rather than by the foregoing description. All changes that come within the meaning and range of equivalency of the claims are to be embraced within their scope.

We claim:

1. A method of making an artificial turf, comprising:

delivering at least first, second, and third distinct yarns from a creel assembly to each respective needle of a plurality of needles;

threading the first, second, and third distinct yarns through an eye of each respective needle of the plurality of needles;

using the plurality of needles to tuft a plurality of rows of individual tufts into a backing layer, wherein each tuft comprises at least the first, second, and third distinct yarns per tuft, wherein each one of the first, second, and third yarns varies from the other yarns of the first, second, and third yarns of the tuft in at least one of material, color, texture, denier, denier per filament, or cross-section;

using a plurality of hook and knife assemblies to hold and cut the individual tufts of the plurality of rows of individual tufts, thereby forming cut tufts, wherein the first, second, and third yarns of each tuft are not twisted together prior to threading through the eye of each needle of the plurality of needles, and wherein the at least first, second, and third yarns of each tuft are simultaneously delivered, by a single needle of the plurality of needles, through the backing layer to produce the tuft, wherein the first yarn is a wrap yarn, wherein the second yarn is a slit tape yarn, and wherein the third yarn is a monofilament yarn.

2. The method of claim 1, wherein the creel assembly comprises at least three post positions associated with each needle of the plurality of needles, and wherein each post position of the plurality of post positions receives a corresponding one of the first, second, and third yarns.

3. The method of claim 2, wherein each tensioner of a plurality of tensioners is associated with a respective one of the first, second, and third yarns, and wherein the method further comprises using each tensioner to selectively modify a tension of the yarn of the first, second, and third yarns that is associated with the tensioner.

4. The method of claim 3, wherein the tension associated with each tensioner of the plurality of tensioners is selectively modified such that substantially equal tension between the first, second and third yarns is delivered to each needle of the plurality of needles.

5. The method of claim 4, further comprising using at least three feed rollers to deliver the respective first, second, and third yarns to the plurality of needles, wherein each feed roller of the three feed rollers is associated with a respective yarn of the first, second, and third yarns.

6. The method of claim 1, wherein at least one yarn of the first, second, and third yarns of each tuft comprises a textured yarn.

7. The method of claim 1, further comprising disposing an infill material on a top surface of the backing layer and in between the tufts of the plurality of rows of individual tufts.

8. The method of claim 7, wherein the infill material comprises at least one of rubber particles, sand or natural materials.

9. The method of claim 1, wherein at least one of the first, second, and third yarns of each tuft comprises a material selected from the group consisting of LDPE, MDPE, Nylon, PP, PET, PLA, and co-extruded biomaterials thereof.

10. The method of claim 1, wherein the wrap yarn, the tape yarn, and the monofilament yarn each comprise a respective material selected from the group consisting of LDPE, MIDPE, Nylon, PP, PET, PLA, and co-extruded biomaterials thereof.

11. The method of claim 10, wherein the wrap yarn comprises polyethylene, wherein the tape yarn comprises polyethylene, and wherein the monofilament yarn is selected from the group consisting of nylon, polyethylene, and polypropylene.

12. The method of claim 11, wherein the monofilament yarn comprises polyethylene.

13. The method of claim 11, wherein the monofilament yarn comprises polypropylene.

14. The method of claim 11, wherein the monofilament yarn comprises nylon.

15. The method of claim 1, wherein the first, second, and third distinct yarns have respective deniers ranging from 100 to 7,500, and wherein the first, second, and third distinct yarns have a combined denier of 10,800 to 16,600, wherein the combined denier is equal to a total of the respective deniers of the first, second, and third distinct yarns.

16. The method of claim 1, wherein each row of the plurality of rows of individual tufts is substantially similar to each adjacent row of the plurality of rows of individual tufts.

* * * * *